US008020401B2

(12) United States Patent
Chen

(10) Patent No.: US 8,020,401 B2
(45) Date of Patent: Sep. 20, 2011

(54) CONFIGURABLE REFRIGERATOR

(76) Inventor: Juei-Chao Chen, Taipei (TW)

( * ) Notice: Subject to any disclaimer, the term of this patent is extended or adjusted under 35 U.S.C. 154(b) by 602 days.

(21) Appl. No.: 12/218,587

(22) Filed: Jul. 17, 2008

(65) Prior Publication Data

US 2009/0165488 A1 Jul. 2, 2009

(30) Foreign Application Priority Data

Jan. 2, 2008 (TW) ..... 97100012 A

(51) Int. Cl.
*F25D 19/00* (2006.01)

(52) U.S. Cl. ..... 62/298; 62/426

(58) Field of Classification Search ..... 62/298, 62/426, 449, 262
See application file for complete search history.

(56) References Cited

U.S. PATENT DOCUMENTS 3,802,216 A * 4/1974 Brandimarte ..... 62/262
4,110,987 A * 9/1978 Cahn et al. ..... 60/652
4,138,993 A * 2/1979 Conley ..... 126/563
4,194,536 A * 3/1980 Stine et al. ..... 138/149
4,261,176 A * 4/1981 Theyse ..... 62/235.1
4,271,679 A * 6/1981 Schafer ..... 62/238.4
4,328,674 A * 5/1982 Wenzel ..... 60/648
4,413,348 A * 11/1983 Kapich ..... 376/367
4,516,402 A * 5/1985 Chang ..... 60/656
4,541,246 A * 9/1985 Chang ..... 60/648
4,705,498 A * 11/1987 Goss ..... 604/6.08
4,818,843 A * 4/1989 Swiatosz ..... 392/397
4,876,856 A * 10/1989 Iishiki et al. ..... 60/671
4,920,276 A * 4/1990 Tateishi et al. ..... 290/2
4,920,750 A * 5/1990 Iishiki et al. ..... 60/671
5,108,695 A * 4/1992 Schulz ..... 376/298
5,485,879 A * 1/1996 Lannes ..... 122/18.31
5,528,114 A * 6/1996 Tokizaki et al. ..... 318/67
5,571,992 A * 11/1996 Maleski et al. ..... 174/36
5,722,229 A * 3/1998 Provost ..... 60/785
6,615,912 B2 * 9/2003 Garner ..... 165/104.26
6,628,206 B1 * 9/2003 Soulier ..... 340/854.4
2002/0195242 A1 * 12/2002 Garner ..... 165/274
2004/0035117 A1 * 2/2004 Rosen ..... 60/772
2004/0037045 A1 * 2/2004 Phillips et al. ..... 361/719
2004/0069546 A1 * 4/2004 Lou et al. ..... 180/65.2

* cited by examiner

*Primary Examiner* — Mohammad Ali

(57) ABSTRACT

A configurable refrigerator comprises a control box provided with a compressor and a fan, a plurality of cooling units that are mutually connected and are connected to the control box through fastening devices, gas tubes connected between the control box and the cooling units to allow a low-temperature gas generated by the control box to enter the cooling units and return to the control box after circulation in the cooling units, and a control panel of the control box, settled on the control box or any of the cooling units. Therein, the control box can be assembled with an adjustable number of the cooling unit. Thus, the number of the cooling units can be increased or decreased as needed, thereby achieving easy assembly, disassembly and reconfiguration of the configurable refrigerator and the control panel.

1 Claim, 14 Drawing Sheets

CONFIGURABLE REFRIGERATOR

BACKGROUND OF THE INVENTION

1. Technical Field

The present invention relates to refrigeration equipment, and more particularly, to a configurable refrigerator composed of a control box and at least one cooling unit that can be easily assembled and disassembled, wherein the number of the cooling unit and the positional arrangement of the control box and the cooling unit(s) are adjustable. Moreover, a control panel of the configurable refrigerator can be settled on any one of the control box and the cooling unit(s) at a user's will.

2. Description of Related Art

Conventional refrigerators are usually unmodifiable combinations of single-door modules, French-door modules and/or drawer modules. Once the conventional refrigerators are fabricated and sold, it is impossible for users to reconfigure these modules, to remove some of the combined modules or add some more modules. Thus, in order to satisfy various consumers, every model of the conventional refrigerators must be manufactured in several door types, although not all of them are needed by the consumers. Besides, the conventional refrigerators usually have relatively large capacity, which means not only increased volume, weight and manufacturing costs, but also potential waste of energy. And yet the conventional refrigerators can never really satisfy every consumer's need. On the other hand, when people want to replace their current small refrigerators with new larger ones, disposition of the small refrigerators would be a problem. Furthermore, on certain special occasions, such as holidays, family reunions or having guests, one may temporarily need more refrigeration space. However, it is a waste of resources and space to prepare in advance a larger refrigerator only for such rare occasions.

SUMMARY OF THE INVENTION

Hence, the primary objective of the present invention is to provide a configurable refrigerator that allows a user to implement an adjustable number and arrangement of refrigerating unit(s) and/or freezing unit(s) (hereinafter referred to as cooling unit(s)), and to configure the cooling unit(s) with the desired door type.

To achieve the foregoing objective, the disclosed configurable refrigerator comprises a control box provided with a compressor and a fan, a plurality of cooling units that are mutually connected and are connected to the control box through fastening devices, gas tubes connected between the control box and the cooling units to allow a low-temperature gas generated by the control box to enter the cooling units and return to the control box after circulation in the cooling units, and a control panel of the control box, settled on the control box or any of the cooling units. Therein, the control box can be assembled with an adjustable number of the cooling units. In other words, the number of the cooling units can be increased or decreased as needed, thereby achieving easy assembly, disassembly and reconfiguration of the configurable refrigerator and the control panel.

BRIEF DESCRIPTION OF THE DRAWINGS

The structure and technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
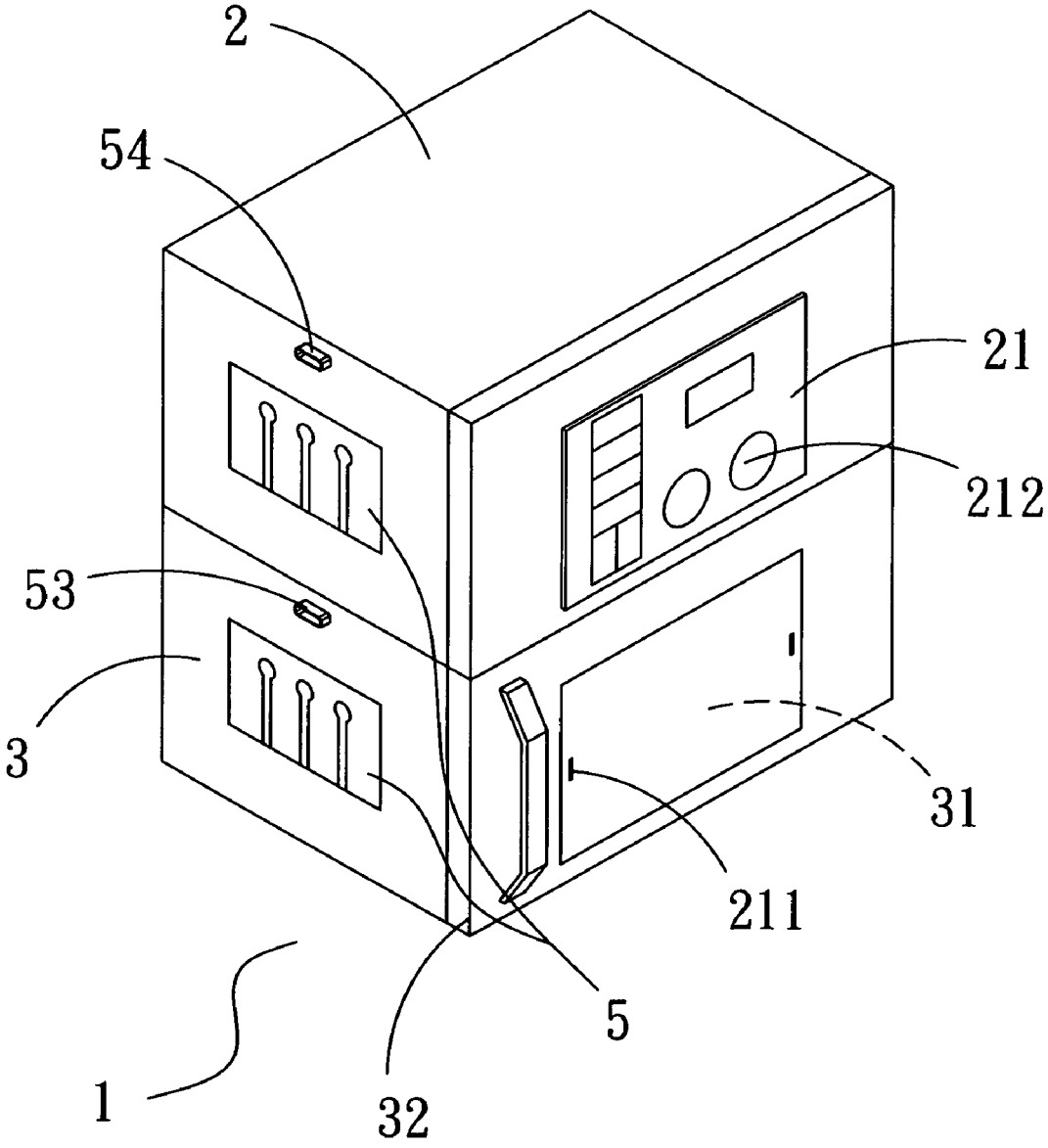
FIG. 1 is a perspective view of a first preferred embodiment of the present invention.
Figure 2:
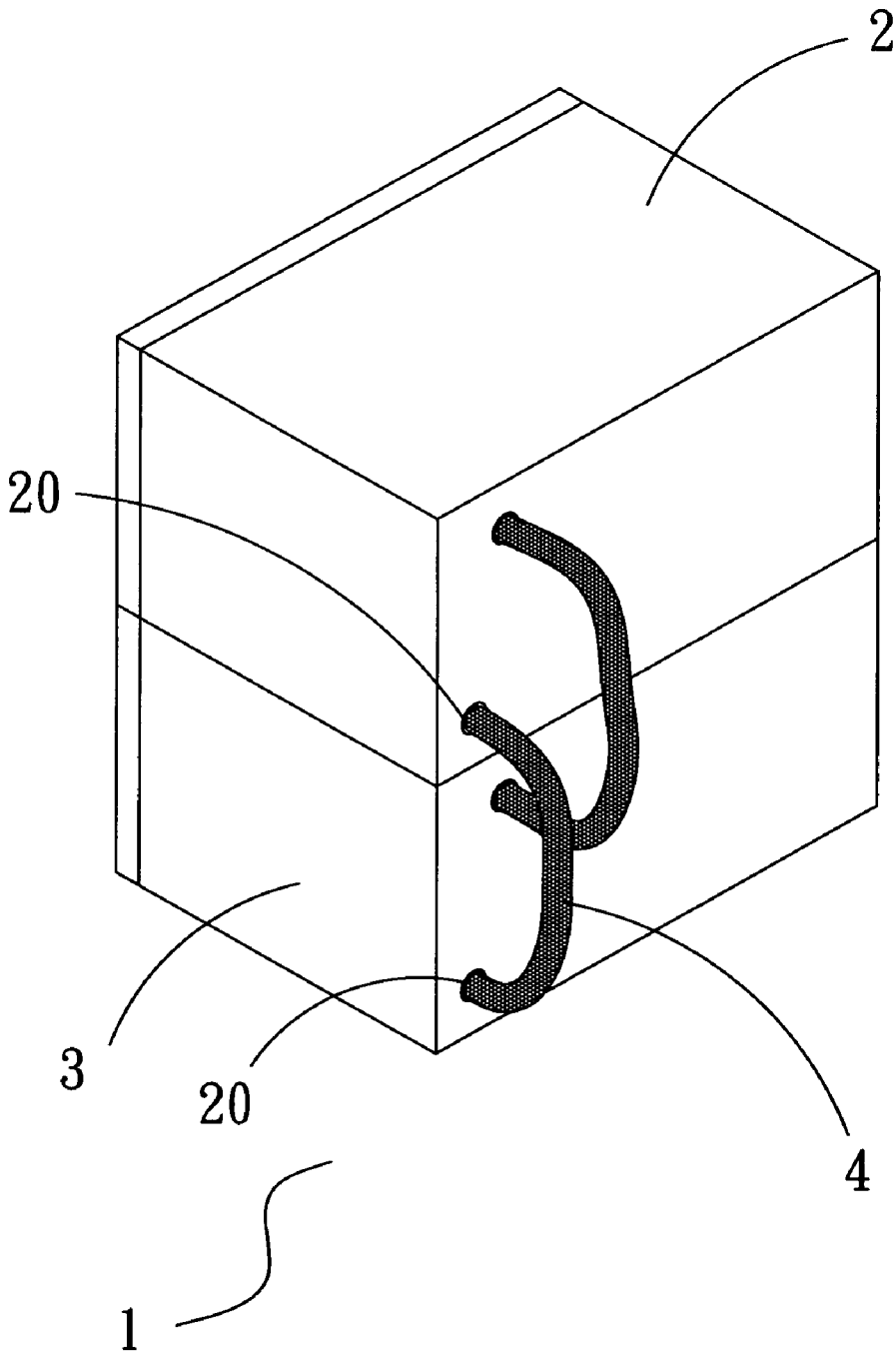
FIG. 2 is another perspective view of the first preferred embodiment of the present invention.
Figure 3:
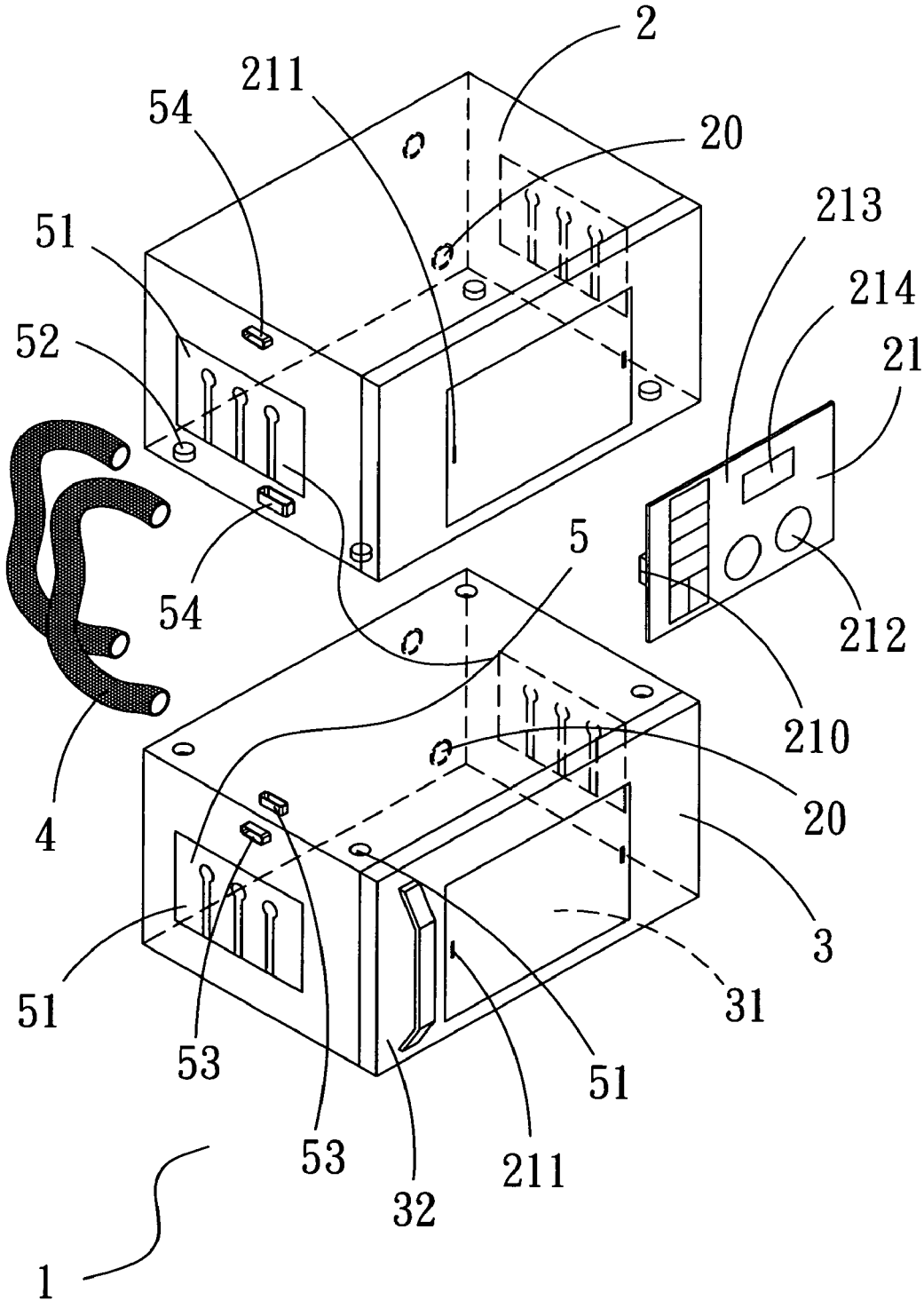
FIG. 3 is a partially exploded view of the first preferred embodiment of the present invention.

Please refer to FIGS. 1, 2 and 3 for perspective views and a partially exploded view of a first preferred embodiment of the present invention. Therein, a configurable refrigerator 1 of the present invention primarily comprises a control box 2, a cooling unit 3, a gas tube 4 and a fastening device 5.

The control box 2 is formed with at least one vent 20 on an outer wall thereof for gaseous communication. A control panel 21 is affixed to a surface of the control box 2 or a surface of the cooling unit 3 by means of magnetic attachment, ridge-groove engagement, projection-recess engagement, or screw engagement. A connecting port 210 and a connecting slot 211 for signal transmission are provided on contacting surfaces of the control panel 21 and the control box 2 (or the cooling unit 3), respectively.

Particularly, the connecting port 210 and the connecting slot 211 of control panel 21 may be in mutual communication through RS232, USB, PS/2, IEEE1394 or any other interface for signal transmission. Besides, the control panel 21 is equipped with a switch 212 for generating control signals, a control circuit 213 and a display 214 for displaying temperature and other conditions inside the cooling unit 3 that are detected by sensors (not shown) installed in the cooling unit 3. The control box 2 is substantially in the form of a known refrigerator, having a compressor serving to generate a low-temperature gas for refrigeration cycles and a fan serving to blow the low-temperature gas to the cooling unit 3. The compressor and the technology for low-temperature gaseous transmission implemented in the present invention are well known in the art and need not be discussed at length herein.

The cooling unit 3 may be provided in the number of one or more. Each said cooling unit 3 is formed with at least one vent 20 that is in gaseous communication with an accommodating space 31 in the cooling unit 3. A door 32 is provided at a lateral surface of the cooling unit 3 and may be a sliding door, a hinged door, a side-open door, a drawer-type door or a French door.

The gas tube 4 is provided in the number of one or more for gaseous communication.

The fastening device 5 functions as a connector between the control box 2 and the cooling unit 3 while comprising a plurality of receiving portions 51 and projecting portions 52. The receiving portions 51 and the projecting portions 52 are coupled to each other by means of magnetic attachment, ridge-groove engagement, projection-recess engagement, or screw engagement. A connecting port 53 and a connecting slot 54 may be arranged adjacent to the fastening device 5 according to coupling portions of the control box 2 and the cooling unit 3, for transmitting electrical signals between the control box 2 and a plurality of the cooling units 3. For example, the connecting port 53 and the connecting slot 54 may be arranged in such a way that they are coupled to each other vertically or horizontally. Moreover, the connecting port 53 and the connecting slot 54 may be connected through an L-shaped wiring so as to realize an L-shaped configuration of the control box 2 and the cooling unit 3.

Particularly, the connecting port 53 and the connecting slot 54 may be in communication with each other through RS232, USB, PS/2, IEEE1394 or any other interface for electrical signal transmission.

Figure 4:
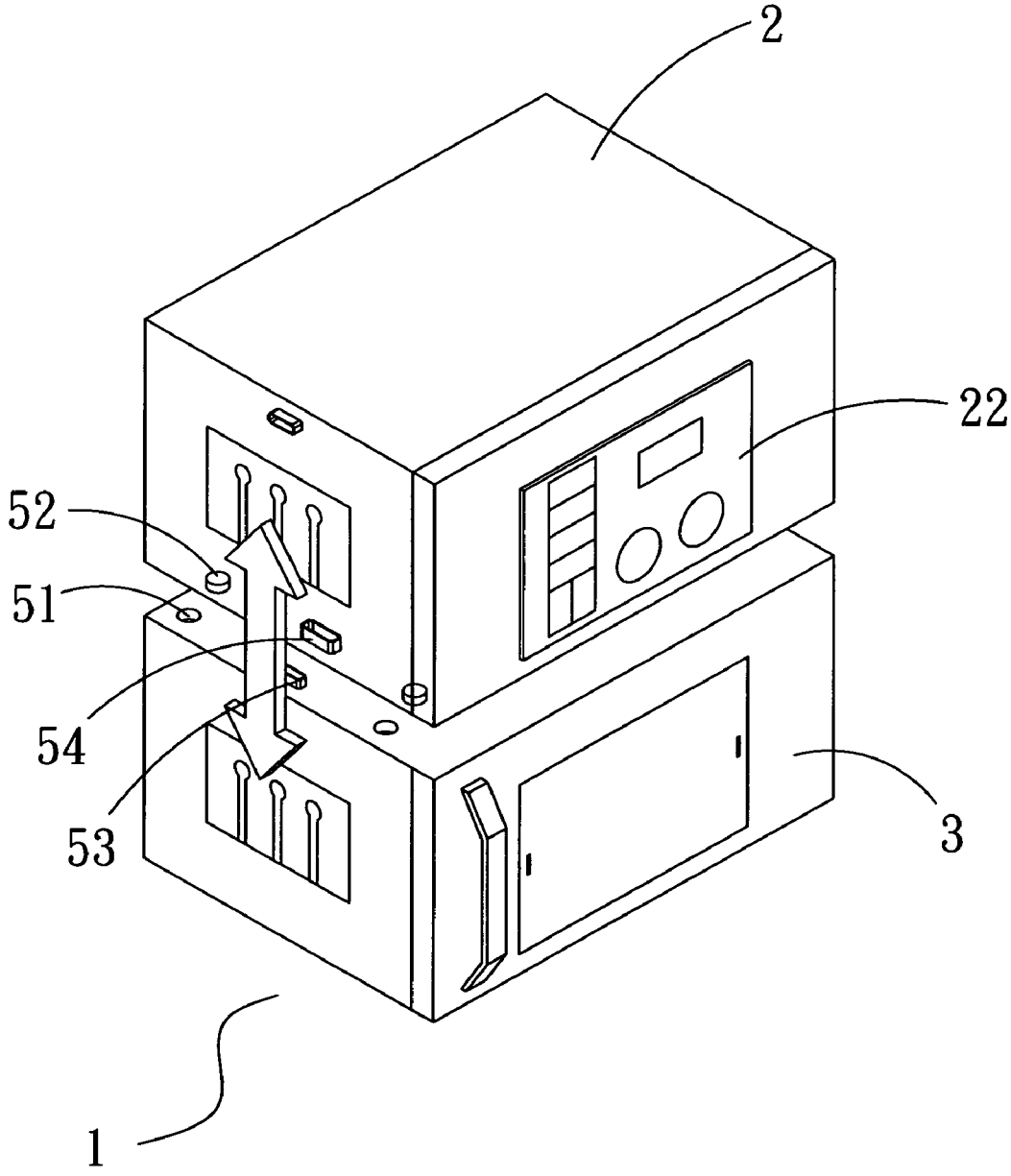
FIG. 4 is a schematic drawing showing assembly of the first preferred embodiment of the present invention.
Figure 5:
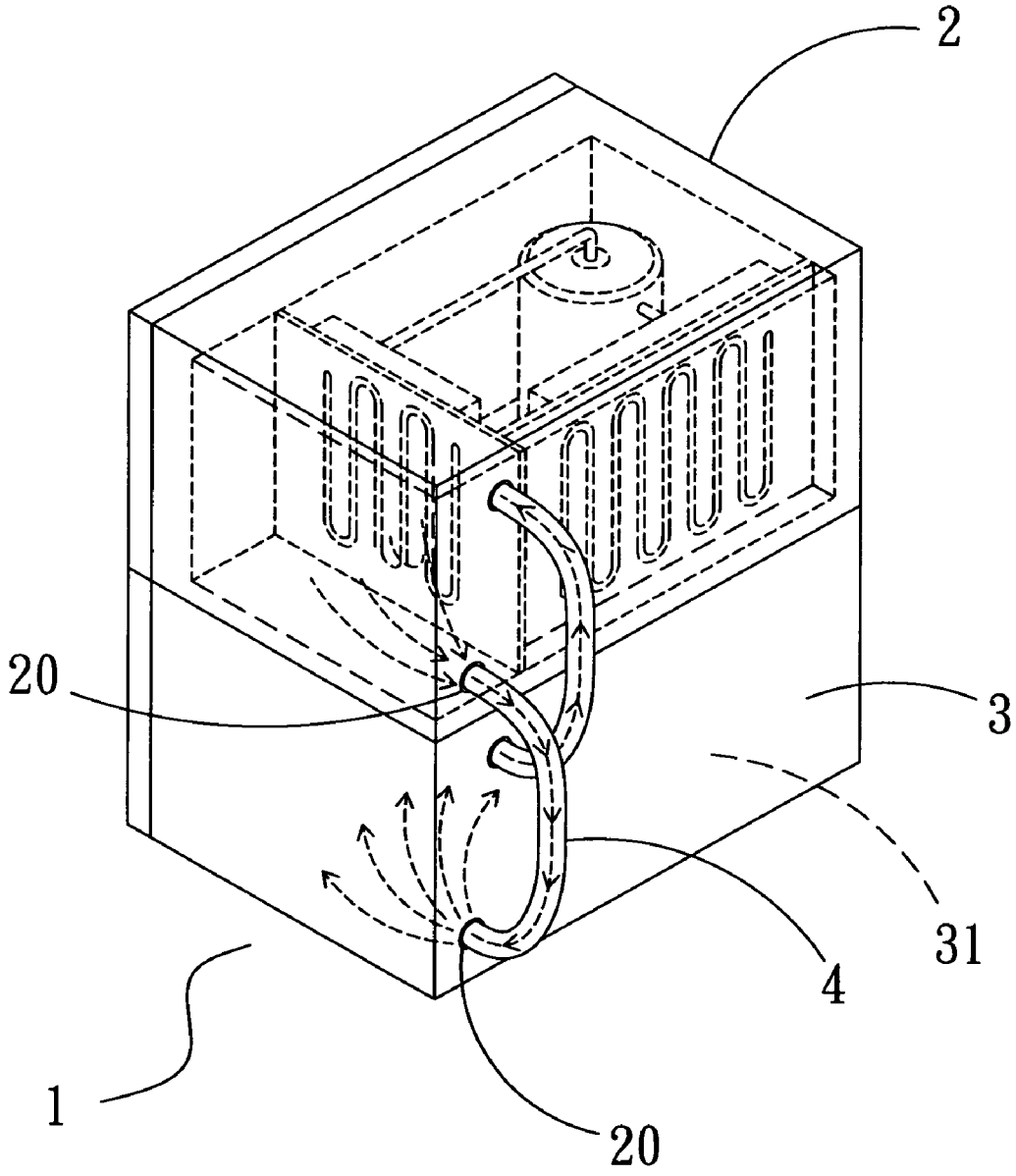
FIG. 5 is a schematic assembled view of the first preferred embodiment of the present invention.

Please also refer to FIGS. 3, 4 and 5 for the partially exploded view and schematic assembled views of the first preferred embodiment of the present invention. According to the drawings, the projecting portions 52 and the connecting slot 54 of the fastening device 5 are provided at a bottom of the control box 2 while the receiving portions 51 and connecting port 53 of the fastening device 5 are provided at a top of the cooling unit 3. Therefore, to assemble the control box 2 with the cooling unit 3, the bottom of the control box 2 is placed on the top of the cooling unit 3 so as to couple the receiving portions 51 with the projecting portions 52, and the connecting port 53 with the connecting slot 54. Afterward, one end of the gas tube 4 is connected to the vent 20 of the control box 2 and an opposite end of the gas tube 4 is connected to the vent 20 of the cooling unit 3. At last, the connecting port 210 of control panel 21 is connected to the connecting slot 211 of the control box 2 and the configurable refrigerator 1 of the present invention is completed. Thus, the low-temperature gas in the control box 2 can enter the cooling unit 3 through one said vent 20 as well as the gas tube 4, while the used low-temperature gas can return to the control box 2 through another said vent 20 after circulation in the cooling unit 3.

The control panel 21 serves to adjust and display the conditions of the control box 2. By operating the switch 212 to generate a control signal to the control circuit 213, the control circuit 213 accordingly helms the fan and the compressor in the control box 2, thereby controlling output conditions of the low-temperature gas, such as temperature, humidity and so on. These output conditions can be presented in the display 214 of the control panel 21 at any time. Furthermore, the switch 212 may be a button switch, a DIP switch, a toggle switch, a knob switch, a stepless knob, a touch panel or an integrated touch display 214. On the other hand, the display 214 may be a liquid crystal display.

Figure 6:
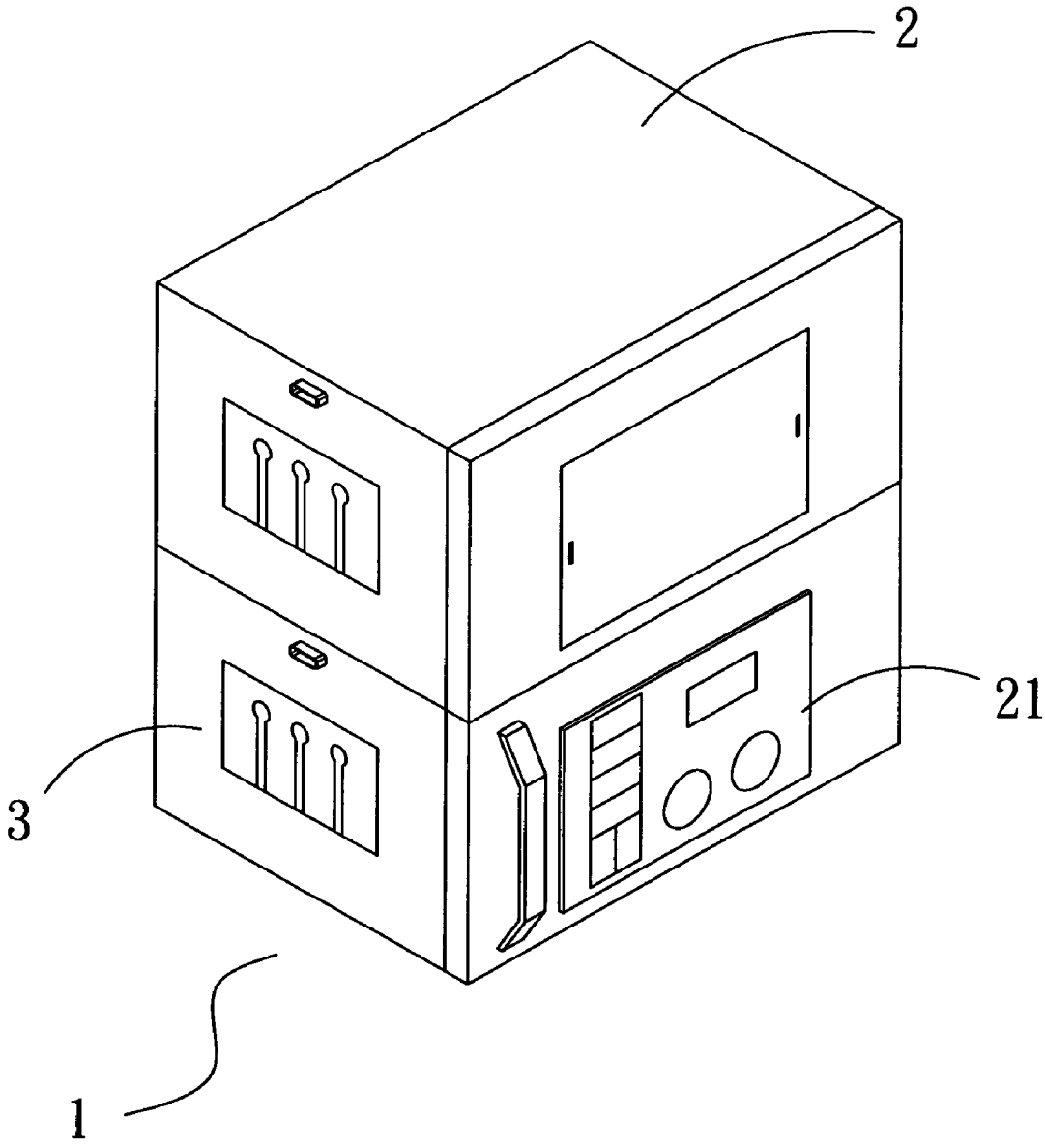
FIG. 6 provides a first exemplificative configuration of the first preferred embodiment of the present invention.

Referring now to FIGS. 3 and 6 for the partially exploded view and a first exemplificative configuration of the first embodiment of the present invention, the control panel 21 is affixed to a surface of the cooling unit 3 by means of magnetic attachment, ridge-groove engagement, projection-recess engagement, or screw engagement. A connecting port 210 and a connecting slot 211 for electrical signal transmission are provided on contacting surfaces of the control panel 21 and the cooling unit 3, respectively.

In addition, the connecting port 210 and connecting slot 211 may be in communication with each other through RS232, USB, PS/2, IEEE1394 or any other interface for electrical signal transmission.

After the control panel 21 is connected to the cooling unit 3, the control signal generated by the switch 212 is transmitted to the control box 2 through the control circuit 213, the connecting port 210, the connecting slot 211, the connecting port 53 and the connecting slot 54. Alternatively, when the receiving portions 51 and the projecting portions 52 are in electrical communication with each other, the control signal generated by the switch 212 is transmitted to the control box 2 through the control circuit 213, the connecting port 210, the connecting slot 211, the receiving portions 51 and the projecting portions 52. Consequently, the fan and the compressor in the control box 2 can control the output conditions of the low-temperature gas, such as temperature, humidity, and so on, while the output conditions are presented in the display 214 of the control panel 21.

Figure 7:
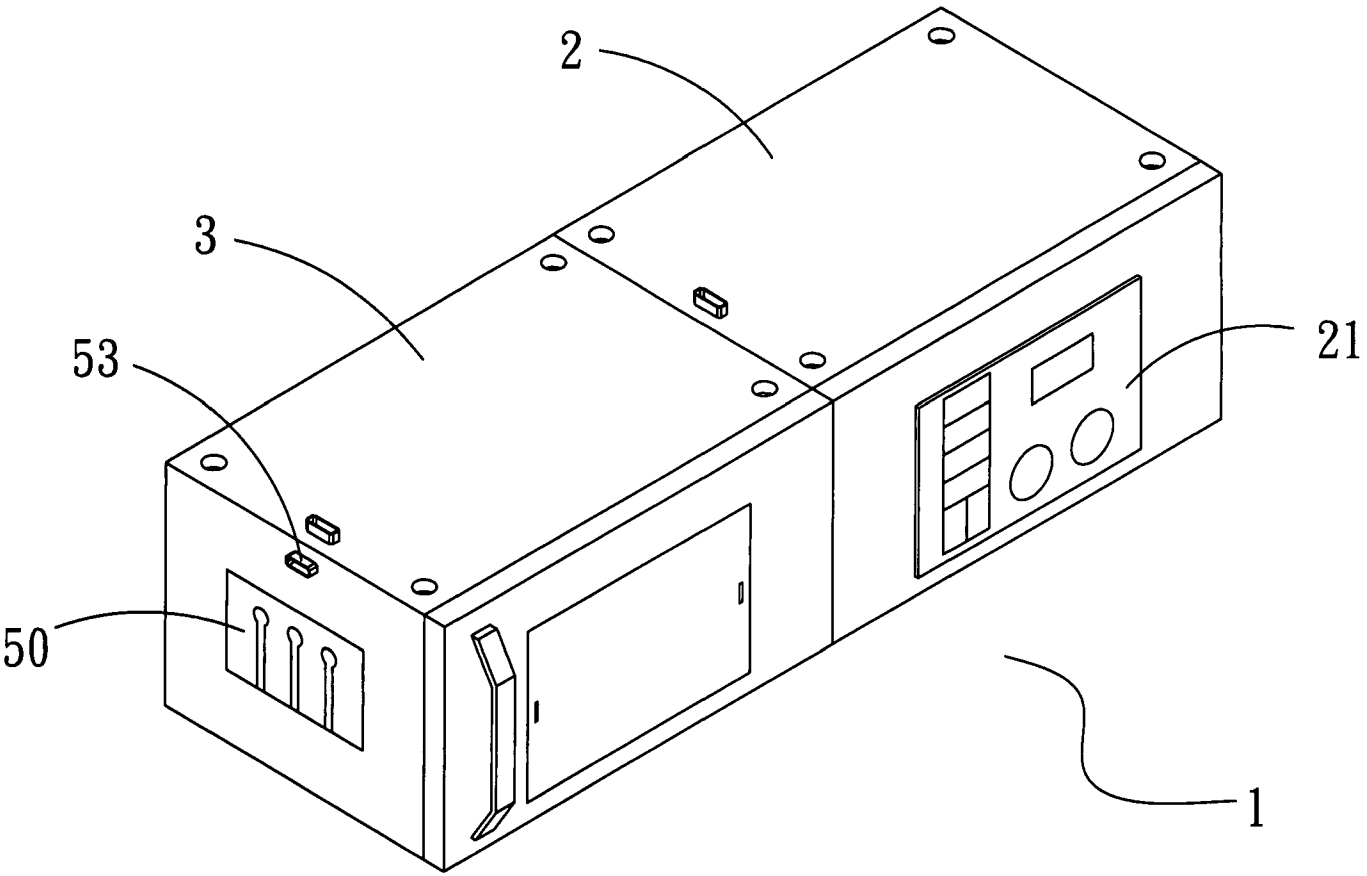
FIG. 7 provides a second exemplificative configuration of the first preferred embodiment of the present invention.

Reference is now made to FIGS. 3 and 7 for the partially exploded view and a second exemplificative configuration of the first embodiment of the present invention. Therein, the projecting portions 52 and the connecting slot 54 of the fastening device 5 are provided at a right (or left) lateral of the control box 2 while the receiving portions 51 and the connecting port 53 of the fastening device 5 are provided at a left (or right) lateral of the cooling unit 3. Therefore, to assemble the control box 2 with the cooling unit 3, the left (or the right) lateral of the control box 2 is set beside the right (or the left) lateral of the cooling unit 3 so as to couple the receiving portion 51 with the projecting portions 52, and the connecting port 53 with the connecting slot 54. Afterward, one end of the gas tube 4 is connected to the vent 20 of the control box 2 and an opposite end of the gas tube 4 is connected to the vent 20 of the cooling unit 3. At last, the connecting port 210 of control panel 21 is connected to the connecting slot 211 of the control box 2 and the configurable refrigerator 1 of the present invention is completed.

Figure 8:
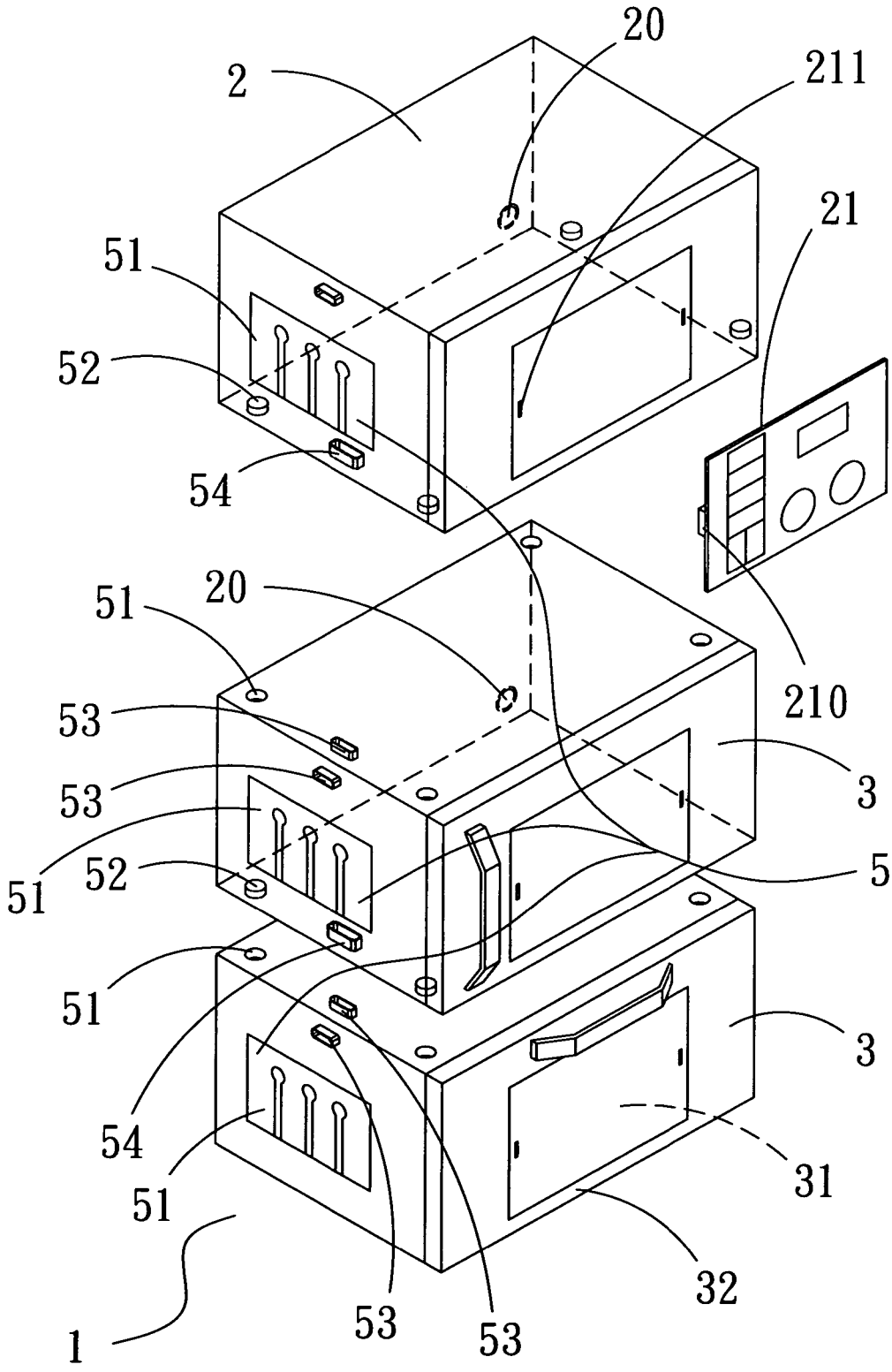
FIG. 8 is a partially exploded view of a second preferred embodiment of the present invention.
Figure 9:
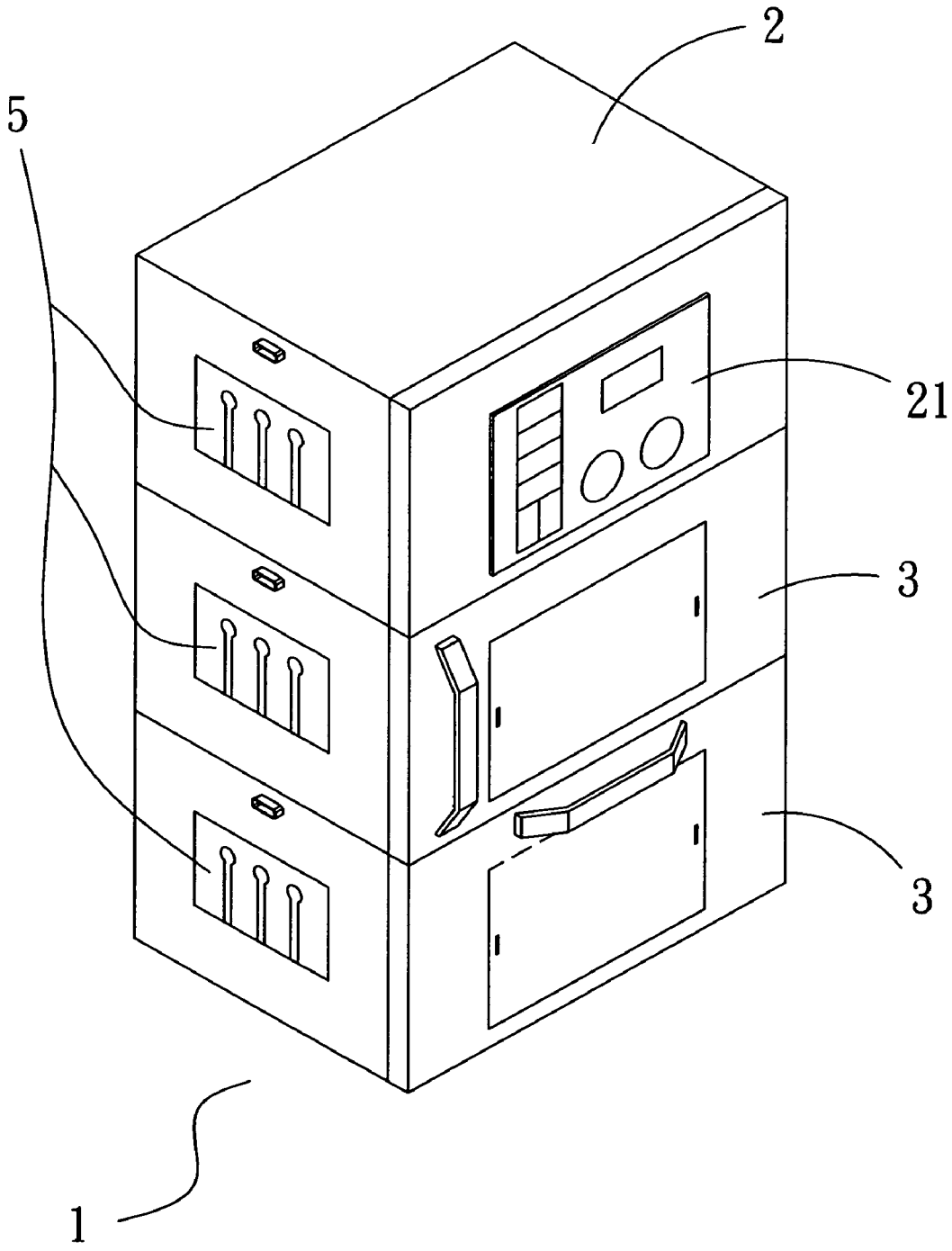
FIG. 9 is a schematic drawing showing assembly of the second preferred embodiment of the present invention.
Figure 10:
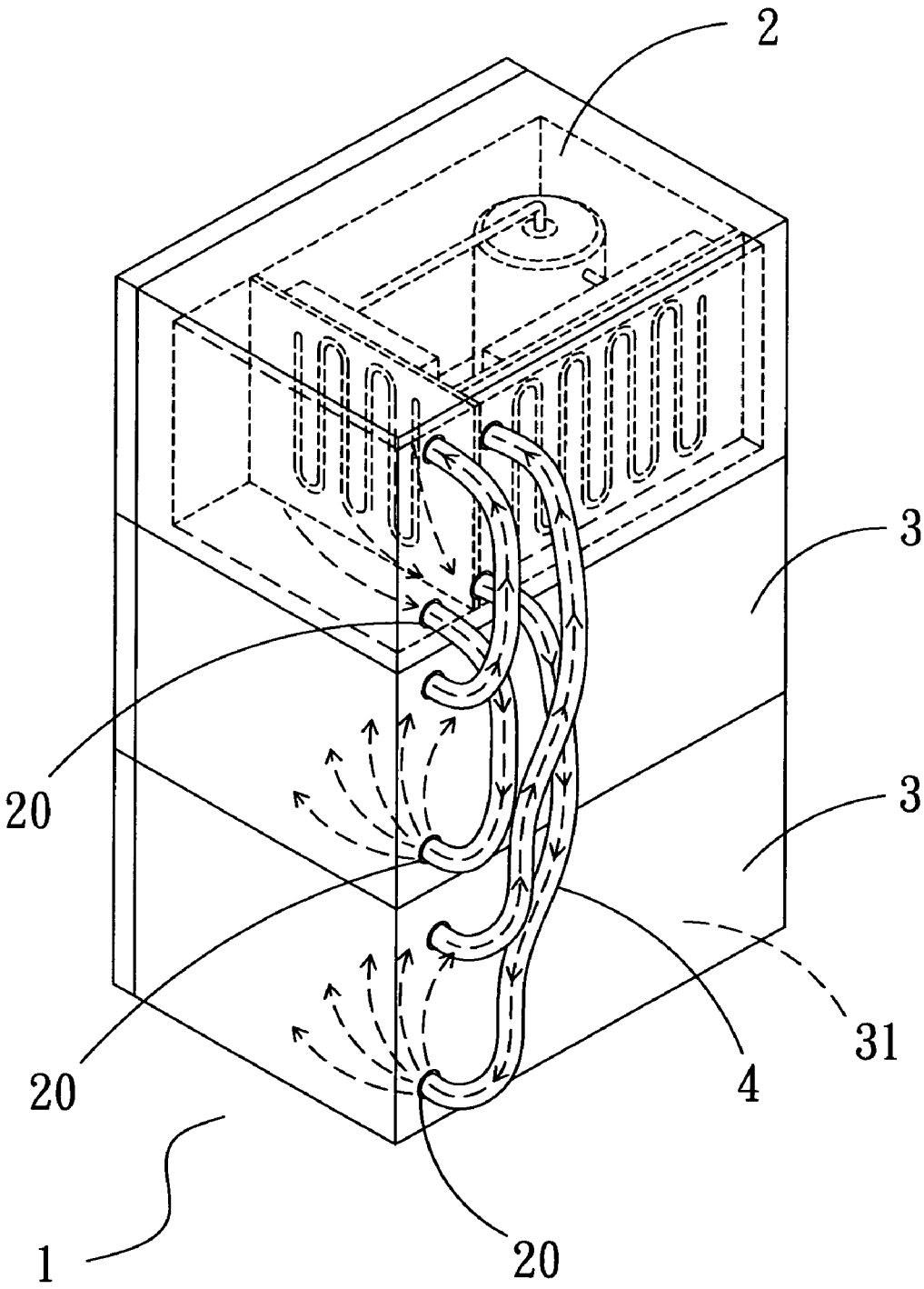
FIG. 10 is a schematic assembled view of the second preferred embodiment of the present invention.

As can be seen in FIGS. 8, 9, and 10, which are a partially exploded view and schematic assembled views of a second preferred embodiment of the present invention, the configurable refrigerator I comprises a control box 2, two cooling units 3, a plurality of gas tubes 4 and fastening device 5. Therein, the control box 2 and the cooling units 3 are vertically stacked.

In the present embodiment, the projecting portions 52 and the connecting slots 54 of the fastening devices 5 are provided at the bottoms of the control box 2 and the cooling unit 3, respectively, while the receiving portions 51 and connecting ports 53 of the fastening devices 5 are provided the tops of the cooling units 3. Therefore, to assemble the control box 2 with the cooling units 3, the control box 2 is placed on the top of one said cooling unit 3, and then another said cooling unit 3 is placed therebelow, so as to couple the receiving portions 51 with the projecting portions 52, and the connecting ports 53 with the connecting slots 54. Afterward, one end of each said gas tube 4 is connected to the vent 20 of the control box 2 and an opposite end of each said gas tube 4 is connected to the vent 20 of each said cooling unit 3. At last, the connecting port 210 of control panel 21 is connected to the connecting slot 211 of the control box 2 and the configurable refrigerator 1 of the present invention is completed. Thus, the low-temperature gas of the control box 2 can enter the cooling units 3 through one said vents 20 as well as the gas tubes 4 while the used low-temperature gas can return to the control box 2 through the other said vents 20 after circulation in the cooling units 3.

Figure 11:
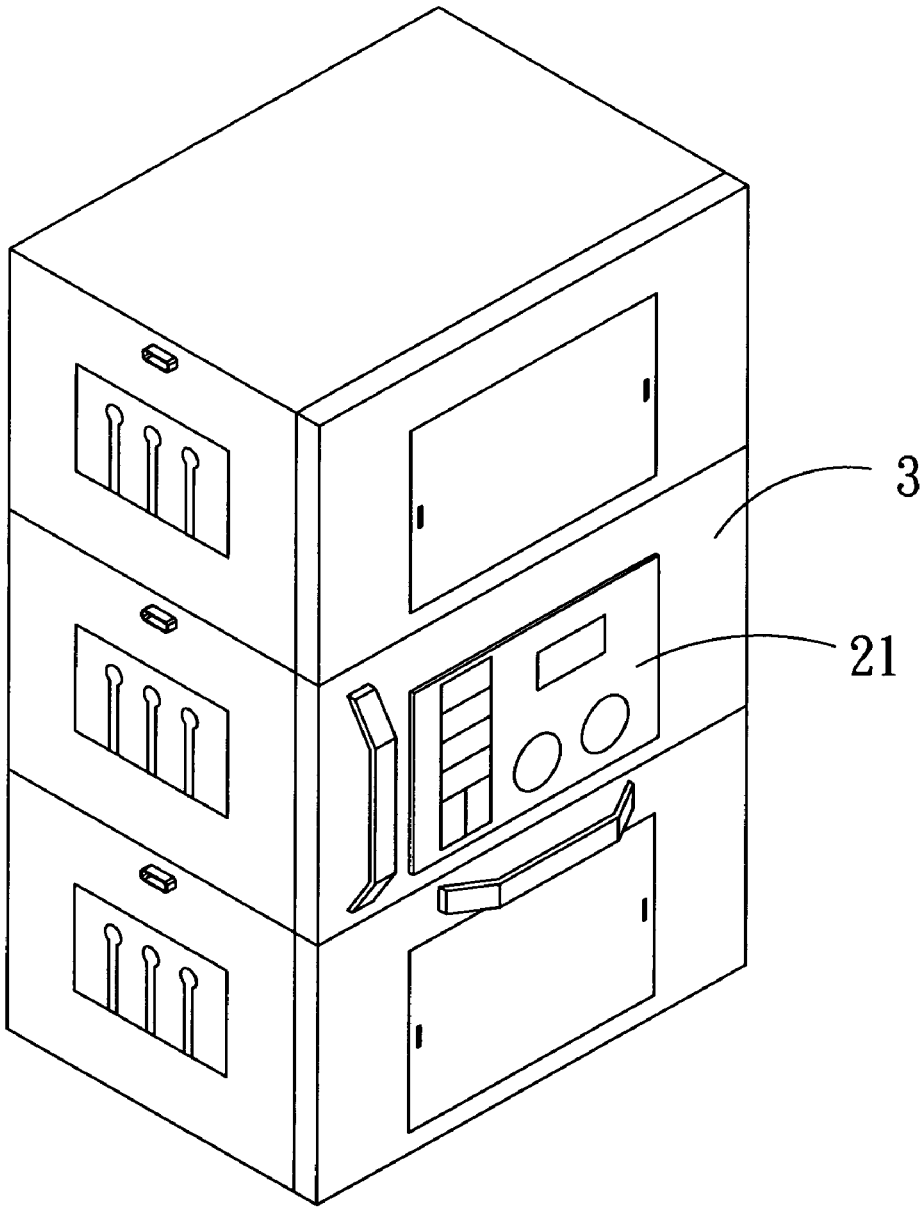
FIG. 11 provides one exemplificative configuration of the second preferred embodiment of the present invention.

FIG. 11 provides a first exemplificative configuration of the second preferred embodiment of the present invention, wherein the control panel 21 is affixed to one of the cooling units 3.

Figure 12:
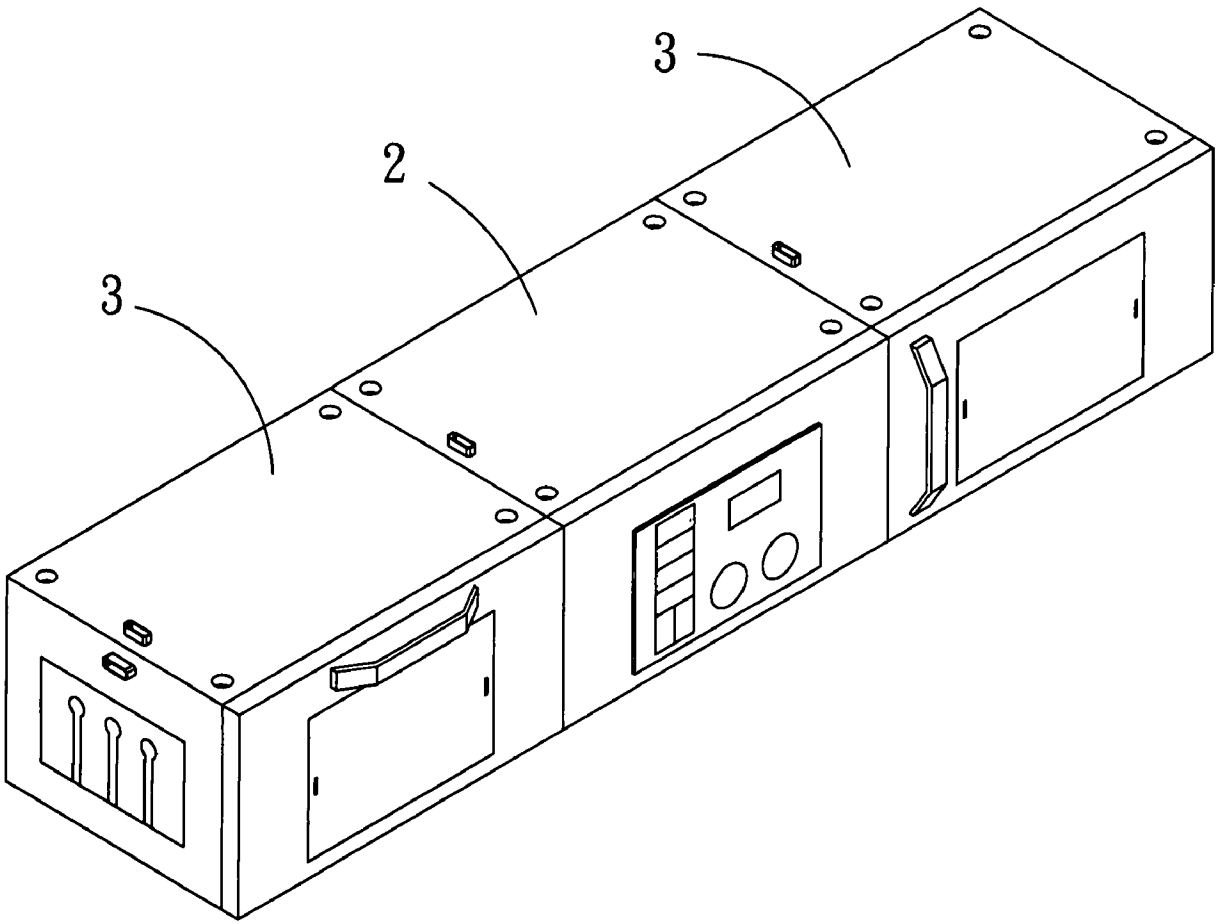
FIG. 12 provides another exemplificative configuration of the second preferred embodiment of the present invention.

FIG. 12 provides a second exemplificative configuration of the second preferred embodiment of the present invention, wherein the control box 2 and the cooling units 3 are arranged abreast.

Figure 13:
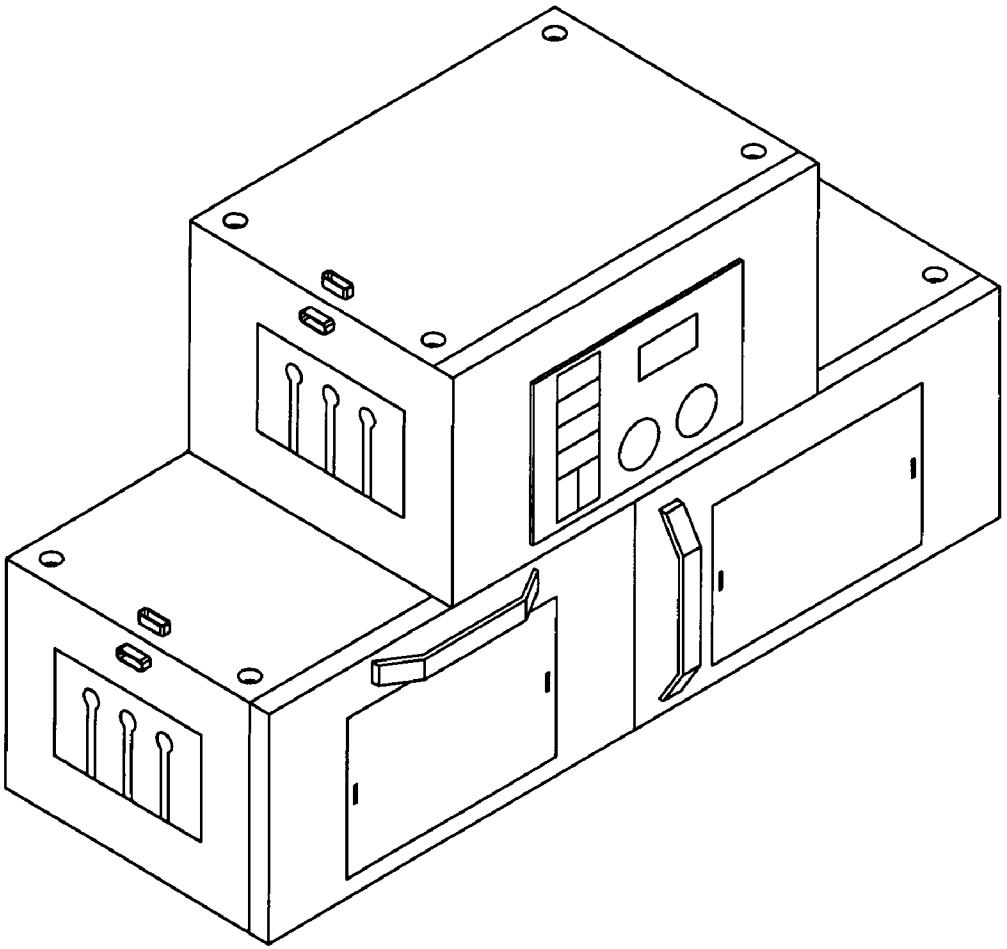
FIG. 13 provides still another exemplificative configuration of the second preferred embodiment of the present invention.
Figure 14:
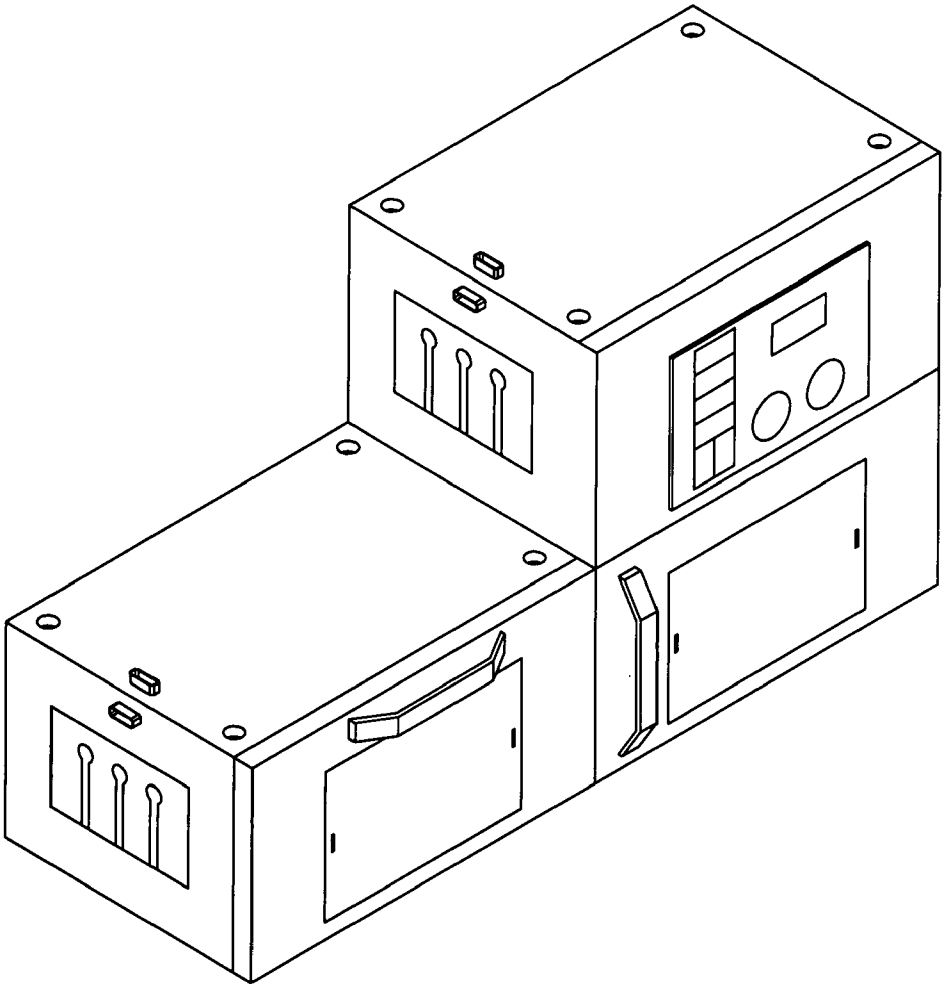
FIG. 14 provides yet another exemplificative configuration of the second preferred embodiment of the present invention.

Also referring to FIGS. 13 and 14, which respectively provide a third and a fourth exemplificative configuration of the second preferred embodiment of the present invention, the control box 2 and the cooling units 3 can be configured into an L shape and an inverted T shape, in addition to the upright and recumbent I shapes shown in FIGS. 9 and 12.

What is claimed is:

1. A configurable refrigerator, comprising a control box for generating a low-temperature gas, having a control panel electrically connected therewith for controlling the control box; at least one cooling unit connected with any surface of the control box and having an accommodating space therein, wherein at least one vent is formed on the cooling unit to communicate the accommodating space with an exterior, and a door is provided at a lateral of the cooling unit; at least one vent set in the control box and the cooling unit for allowing the low-temperature gas generated by the control box to enter the cooling unit and return to the control box after circulation in the cooling unit; and at least one gas tube connected between the at least one vent; the configurable refrigerator being characterized in-that the control box is capable of being assembled with one or more said cooling units, and the configurable refrigerator is modifiable with respect to a type with a number of the cooling unit with a variable positional arrangement of the control box and the cooling unit with respect to each other; the control box is formed with at east one vent on an outer wall thereof for gaseous communication; the control panel is affixed to the surface of the control box or a surface of the cooling unit by means of magnetic attachment, ridge-groove engagement, projection-recess engagement, or screw engagement; a connecting port and a connecting slot for signal transmission are provided on contacting surfaces of the control panel and the control box or the cooling unit; the connecting port and the connecting slot of the control panel are connected in mutual communication for signal transmission; the control panel is equipped with a switch for generating control signals, a control circuit and a display for displaying temperature and other conditions inside the cooling unit, the temperature and other conditions are detected by sensors pre-installed in the cooling unit; the cooling unit is provided in the number of one or more; each said cooling unit is formed with at least one vent for gaseous communication with an accommodating space in the cooling unit; a door is provided at a lateral surface of the cooling unit and the door comprises one of a sliding door, a hinged door, a side-open door, a drawer-type door or a French door; the gas-tube is provided in the number of one or more for gaseous communication; a fastening device functions as a connector between the control box and the cooling unit while comprising a plurality of receiving portions and projecting portions; the receiving portions and the projecting portions are coupled to each other by means of magnetic attachment, ridge-groove engagement, projection-recess engagement, or screw engagement; a connecting port and a connecting slot are arranged adjacent to the fastening device and connected to coupling portions of the control box and the cooling unit for transmitting electrical signals between the control box and a plurality of the cooling units; the connecting port and the connecting slot are arranged and coupled to each other vertically or horizontally; the connecting port and the connecting slot are connected through an L-shaped wiring; wherein, the projecting portions and the connecting slot of the fastening device are provided at a bottom of the control box while the receiving portions and connecting port of the fastening device are provided at a top of the cooling unit; to assemble the control box with the cooling unit, the bottom of the control box is placed on the top of the cooling unit to couple the receiving portions with the projecting portions, and the connecting port with the connecting slot; and one end of the gas tube is connected to the vent of the control box and an opposite end of the gas tube is connected to the vent of the cooling unit; wherein, the connecting port of control panel is connected to the connecting slot of the control box ; wherein, the low-temperature gas in the control box enter the cooling unit through one said vent as well as the gas tube, and the low-temperature gas can return to the control box through another said vent after circulation in the cooling unit; wherein the control panel serves to adjust and display the conditions of the control box by operating switch to generate a control signal to the control circuit, and the control circuit operates fan and the compressor in the control box, and controls the output conditions of the low-temperature gas, the temperature, humidity and so on; and the output conditions are presented in the display of the control panel at any time; the switch comprises a button switch, a DIP switch, a toggle switch, a knob switch, a stepless knob, a touch panel or an integrated touch display; the display comprises a liquid crystal display.

* * * * *